US012716253B1

(12) United States Patent
Wearmouth

(10) Patent No.: US 12,716,253 B1
(45) Date of Patent: Aug. 25, 2026

(54) STACKABLE STAIRCASE

(71) Applicant: SafeSmart, LLC, Santa Fe Springs, CA (US)

(72) Inventor: Shane Joseph Wearmouth, Los Angeles, CA (US)

(73) Assignee: SafeSmart, LLC, Santa Fe Springs, CA (US)

( * ) Notice: Subject to any disclaimer, the term of this patent is extended or adjusted under 35 U.S.C. 154(b) by 446 days.

(21) Appl. No.: 18/466,269

(22) Filed: Sep. 13, 2023

(51) Int. Cl.
*E04G 27/00* (2006.01)

(52) U.S. Cl.
CPC ..... *E04G 27/00* (2013.01)

(58) Field of Classification Search
CPC .. E04G 27/00; E04G 1/14; E04G 1/17; E04G 5/10
USPC ..... 182/106
See application file for complete search history.

(56) References Cited

U.S. PATENT DOCUMENTS

| | | | | |
|---|---|---|---|---|
| 2,467,688 | A * | 4/1949 | Oertle | E04G 1/14 52/637 |
| 5,385,215 | A * | 1/1995 | Williams | E04G 5/14 182/113 |
| 5,491,939 | A | 2/1996 | Wang | |
| 5,492,197 | A * | 2/1996 | Yonahara | E04G 3/20 182/83 |
| 7,258,199 | B2 | 8/2007 | Hayes | |
| 7,971,408 | B2 | 7/2011 | Hayes | |
| 8,771,544 | B2 | 7/2014 | Hopper | |
| 10,370,856 | B2 | 8/2019 | Michels | |
| 10,794,062 | B2 | 10/2020 | Michels | |
| 2005/0263351 | A1* | 12/2005 | Hayes, Sr. | E04G 27/00 182/178.1 |
| 2008/0017448 | A1* | 1/2008 | Hayes, Sr. | E04G 27/00 182/178.1 |
| 2009/0100614 | A1* | 4/2009 | Dale | B63B 27/14 14/71.3 |
| 2011/0088973 | A1* | 4/2011 | Shih | E04G 5/10 182/115 |
| 2011/0271613 | A1* | 11/2011 | Hopper | F03D 80/80 52/185 |
| 2022/0235562 | A1* | 7/2022 | Trask | E04G 5/14 |

FOREIGN PATENT DOCUMENTS

| | | | | |
|---|---|---|---|---|
| AU | 2021209297 | A1 | 2/2023 | |
| CN | 212317342 | U | 1/2021 | |
| CN | 113047551 | A | 6/2021 | |
| CN | 219196671 | U | 6/2023 | |
| DE | 4306729 | A1 * | 9/1994 | E04G 5/10 |
| EP | 2692964 | A2 | 2/2014 | |

(Continued)

*Primary Examiner* — Zoe Tam Tran
(74) *Attorney, Agent, or Firm* — Luedeka Neely, P.C.

(57) ABSTRACT

A staircase module and a method for assembling a temporary staircase. The staircase module includes a first frame member and a second frame member each having elongate tubular vertical columns and multiple spaced-apart tubular rungs connecting the elongate tubular vertical columns, first and second stair assemblies attached to spaced-apart tubular rungs on the first and second frame members, a first side brace bolted to the first and second frame members, a second side brace bolted to the first and second frame members, wherein the second side brace includes an access gate, and a connector post attached to each of the elongate tubular vertical columns.

17 Claims, 14 Drawing Sheets

(56) References Cited

FOREIGN PATENT DOCUMENTS

| | | | | | |
|---|---|---|---|---|---|
| EP | 3812337 | A1 | * | 4/2021 | ..... E04H 12/344 |
| FR | 2914671 | A1 | * | 10/2008 | ..... E04G 5/141 |
| GB | 2461782 | A | * | 1/2010 | ..... E04G 5/10 |

* cited by examiner

STACKABLE STAIRCASE

TECHNICAL FIELD

The disclosure is directed to staircase modules and in particular to stackable stair modules for erecting temporary staircases.

BACKGROUND AND SUMMARY

Construction and maintenance sites often require ladders or scaffolding to provide an above or below ground workspace. However, scaffolding and ladders are typically only useful when the above or below ground elevation does not involve a high rise building or a deep excavation shaft. For such high rise buildings or deep excavation shafts, safety regulations require a more substantial workspace. Also, scaffolding is cumbersome and time-consuming to assemble and above a certain height may not provide a stable workspace. Scaffolding and ladders may also not be stable enough to hold heavy construction equipment needed for the construction site.

It is sometimes required that a staircase be provided at a construction or maintenance site so that the staircase can be quickly assembled and disassembled as needed. The staircase must also meet the workspace safety requirements of Occupational Safety and Health Administration (OSHA) regulations for stair designs. Such OSHA stair designs are restricted to construction and maintenance personnel and are not intended for pedestrian use and are not American with Disability Act (ADA) compliant.

In view of the above, what is needed is an easily assembled staircase that provides for worker safety and can be assembled and disassembled quickly. What is also needed is a staircase that can be assembled from the top to extend down into an excavation.

In accordance with embodiments of the disclosure, there is provided a staircase module and method for assembling a staircase. Each staircase module includes a first frame member having first and second elongate tubular vertical columns and multiple spaced-apart tubular rungs connecting the first and second elongate tubular vertical columns, a second frame member having third and fourth elongate tubular vertical columns and multiple spaced apart tubular rungs connecting the third and fourth elongate tubular vertical columns, a first stair assembly attached to a first tubular rung of the multiples spaced-apart tubular rungs on the first frame member and to a third tubular rung of the multiple spaced-apart tubular rungs on the second frame member, a second stair assembly attached to the third tubular rung of the multiple spaced-apart tubular rungs on the second frame member and to a fifth tubular rung of the multiple spaced-apart tubular rungs on the first frame member, a first side brace bolted to the first and second frame members, a second side brace bolted to the first and second frame members, wherein the second side brace further comprises an access gate, and a connector post attached to at least a first end of each of the first, second, third, and fourth, elongate tubular vertical columns.

In some embodiments, the second side brace has two access gates. In other embodiments, the access gates are provided at each four foot interval.

In some embodiments, the first tubular rung, third tubular rung, and fifth tubular rung comprise rectangular tubes. In other embodiments, each of the first and second stair assemblies have rectangular notches configured for assembly to the first, third, and fifth tubular rungs.

In some embodiments a handrail assembly is attached between the first and second stair assemblies.

In some embodiments, each of the first and second stair assemblies comprises a plurality of stair treads between two landings.

In some embodiments, the staircase module is made entirely of aluminum.

In some embodiments, the staircase module includes a plurality of lifting lugs.

In some embodiments there is provided a staircase that includes a plurality of staircase modules that are stacked together to provide the staircase.

In some embodiments there is provide a method for assembling a staircase. The method includes pre-assembling at least a first and a second staircase module. Each first and second staircase module includes a first frame member having first and second elongate tubular vertical columns and multiple spaced-apart tubular rungs connecting the first and second elongate tubular vertical columns, a second frame member having third and fourth elongate tubular vertical columns and multiple spaced apart tubular rungs connecting the third and fourth elongate tubular vertical columns, a first stair assembly attached to a first tubular rung of the multiples spaced-apart tubular rungs on the first frame member and to a third tubular rung of the multiple spaced-apart tubular rungs on the second frame member, a second stair assembly attached to the third tubular rung of the multiple spaced-apart tubular rungs on the second frame member and to a fifth tubular rung of the multiple spaced-apart tubular rungs on the first frame member, a first side brace bolted to the first and second frame members, a second side brace bolted to the first and second frame members, wherein the second side brace further comprises an access gate, and a connector post attached to at least a first end of each of the first, second, third, and fourth, elongate tubular vertical columns. The second staircase module is lifted and the first, second, third and fourth elongate tubular vertical columns of the second staircase module are aligned with the first, second, third and fourth elongate tubular vertical columns of the first staircase module. The second staircase module is attached to the first staircase module using the connecting post.

In some embodiments, the second staircase module is attached above the first staircase module. In other embodiments, the second staircase module is attached below the first staircase module.

In some embodiments, the step of pre-assembling includes pre-assembling three or more staircase modules. In other embodiments, the staircase includes 3 to 15 staircase modules.

An advantage of the embodiments of the disclosure is that it provides improved safety with an ability to extend the staircase easily and quickly above ground and below ground. The unique design of the stair tread also enables the multiple egress and ingress points to the staircase.

BRIEF DESCRIPTION OF THE DRAWINGS

Other features and advantages of the disclosed embodiments may be evident by reference to the attached drawings in combination with the following disclosure, wherein.

DETAILED DESCRIPTION

Figure 1:
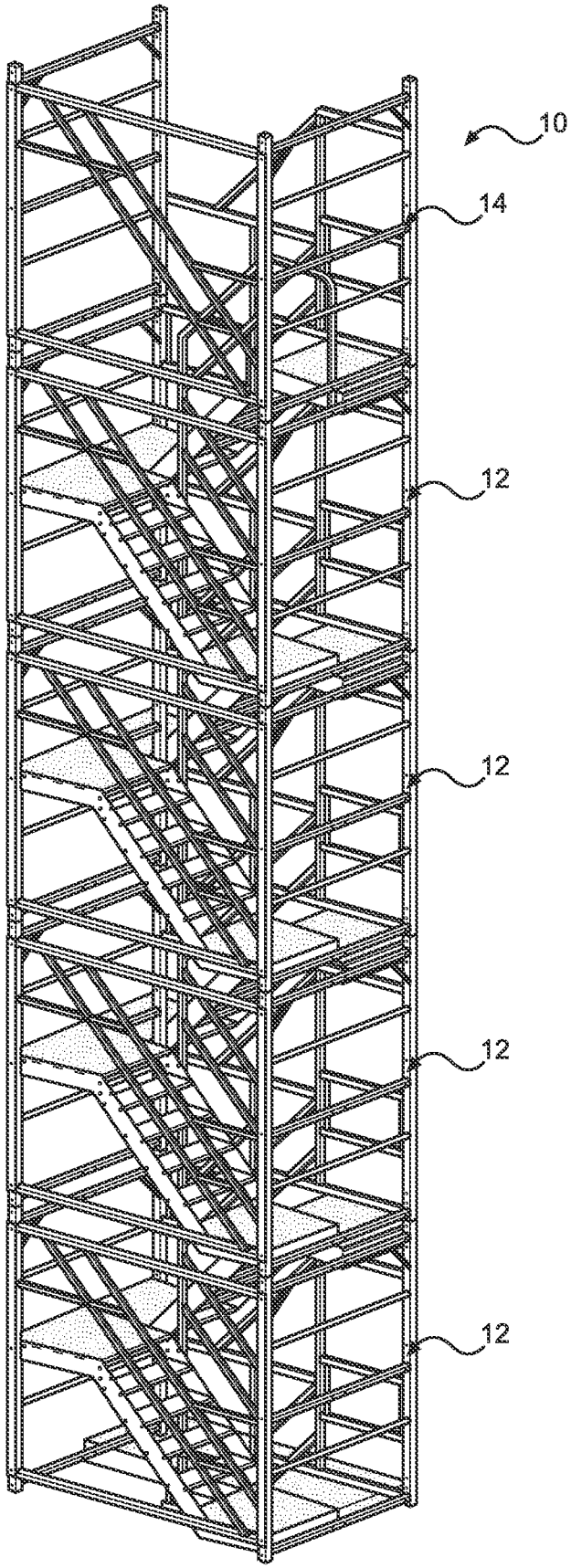
FIG. 1 is a perspective view, not to scale, of a staircase according to an embodiment of the disclosure.
Figure 2:
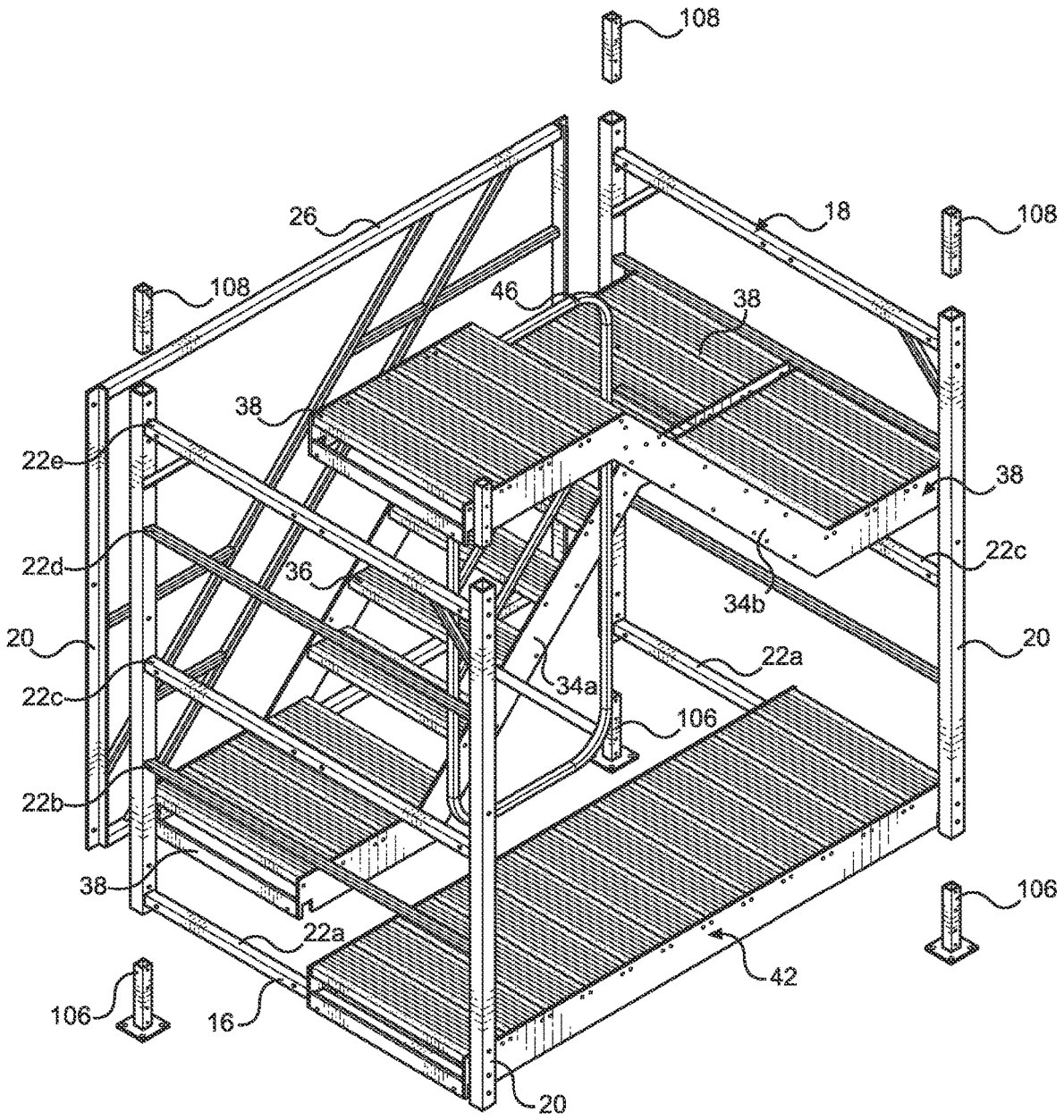
FIG. 2 is an exploded, perspective view, not to scale, of a stair module for the staircase of FIG. 1.
Figure 3:
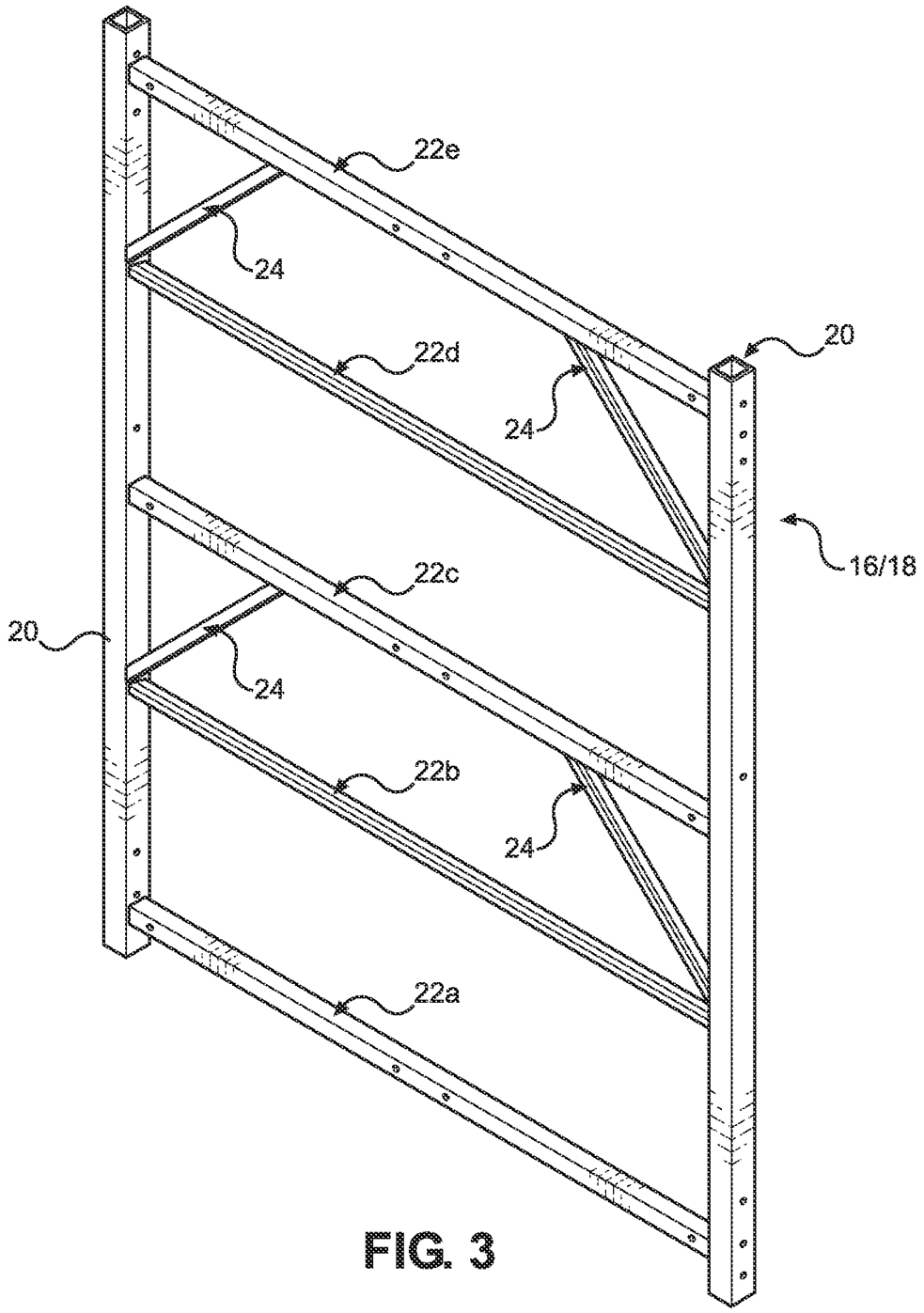
FIG. 3 is a perspective view, not to scale, of details of a frame member for a stair module according to FIG. 2.

With reference to FIG. 1 there is provided a staircase 10 according to the disclosure that includes four staircase modules 12 and a top-level module 14. FIG. 2 illustrates close up exploded portion of the staircase module 12. Each staircase module 12 includes a first frame member 16 and a second frame member 18. Each frame member includes two elongate tubular vertical columns 20 and a plurality of tubular rungs 22, including rectangular rungs 22*a*, 22*c* and 22*e* and round rungs 22*b* and 22*d*, welded horizontally between the two elongate tubular vertical columns 20. FIG. 3 provides more details of the first and second frame members 16 and 18. As shown in FIG. 3, diagonal bracing 24 may be provided between the rectangular tubular rungs 22*c* and 22*e* and the elongate tubular vertical columns 20 to support the stair assemblies 34*a* and 3*b* described below.

Figure 4:
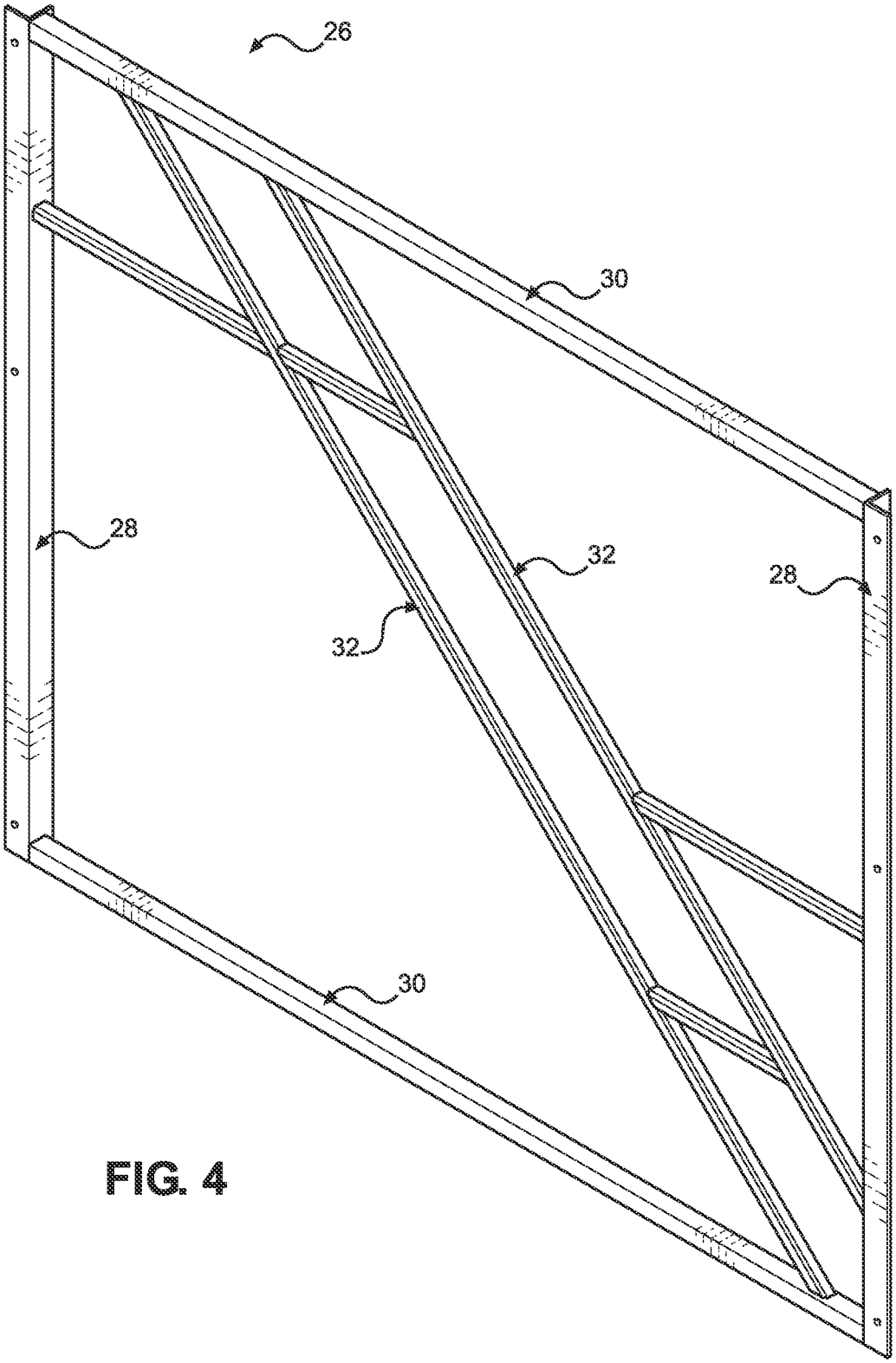
FIG. 4 is a perspective view, not to scale, of details of a first side brace for the stair module of FIG. 2.

With reference again to FIG. 2, each staircase module 12 also includes a first side brace 26 that is bolted to the elongate tubular columns 20 on the first frame member 16 and the second frame member 18. A more detailed view of the first side brace 26 is illustrated in FIG. 4. The first side brace 26 includes vertical angle members 28 and horizontal tubular members 30 welded to the vertical angle members 28. The first side brace 26 also includes a pair of spaced-apart diagonal members 32 providing a handrail for the staircase module 12 on the first brace side thereof. The spaced apart diagonal members 32 are welded to one of the vertical angle members 28 and to horizontal tubular members 30.

Figure 5:
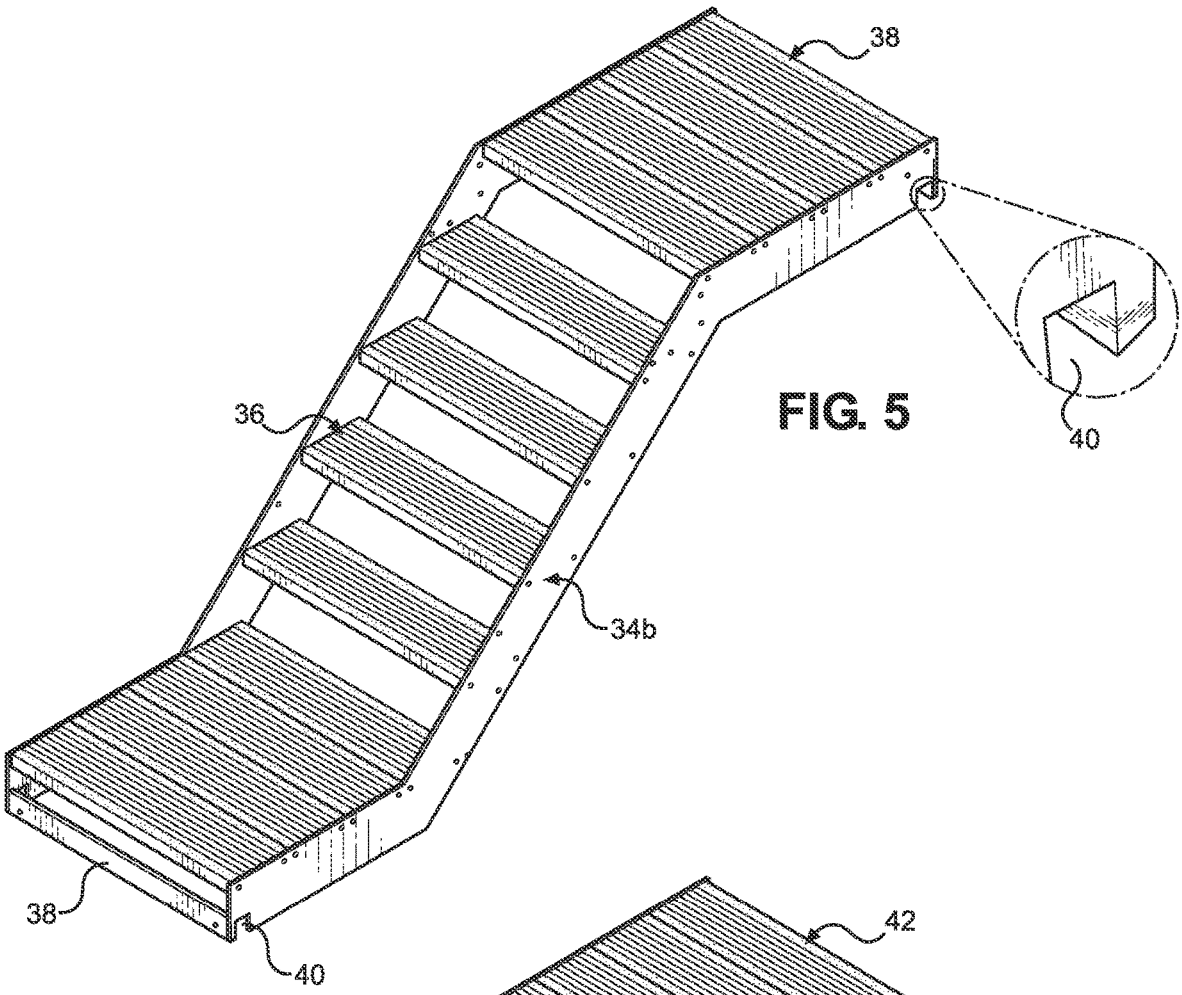
FIG. 5 is a perspective view, not to scale, of a stair assembly for the stair module of FIG. 2.

Referring again to FIG. 2, the staircase module 12 includes a first stair assembly 34*a*, including stair treads 36 and landings 38 that is attached to the rectangular tubular rung 22*a* on the first frame member 16 and to the third rectangular tubular rung 22*c* on the second frame member 18. A second stair assembly 34*b* includes stair treads 36 and landings 38 and is attached to the rectangular tubing rung 22*e* on the first frame member 16 and to the third rectangular tubular rung 22*c* on the second frame member 18. As shown in FIG. 5, each end of the stair assembly 34*a* and 34*b* has a notch 40 for engaging the rectangular tubular rungs 22 on the first and second frame members 16 and 18.

Figure 6:
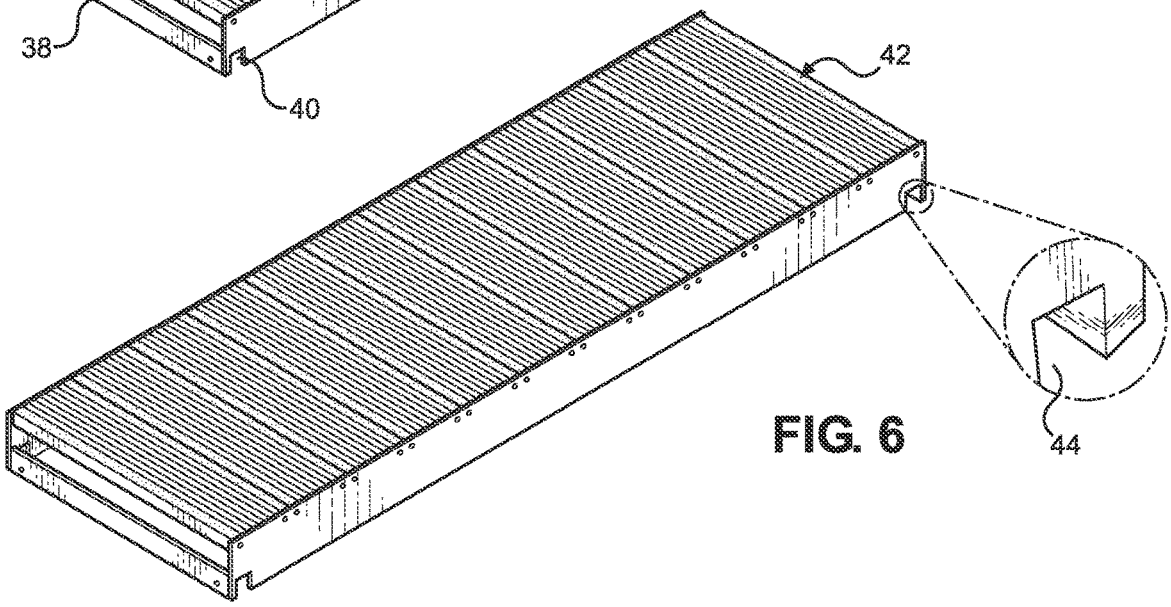
FIG. 6 is a perspective view, not to scale, of an access deck for the stair module of FIG. 2.

In some embodiments, the staircase module 12 may include an access deck 42 that is attached to the tubular rungs 22*a* and 22*b* on the first and second frame members 18 and 20. Like the stair assemblies 34*a* and 34*b*, as shown in FIG. 6, the access deck also includes a notch 44 on each end thereof for connecting the access deck 42 to the first rectangular tubular rung 22*a* on the first frame member 16 and the second frame member 18. The stair treads 36, landings 38 and access decks 42 are all provided with non-slip surfaces.

Figure 7:
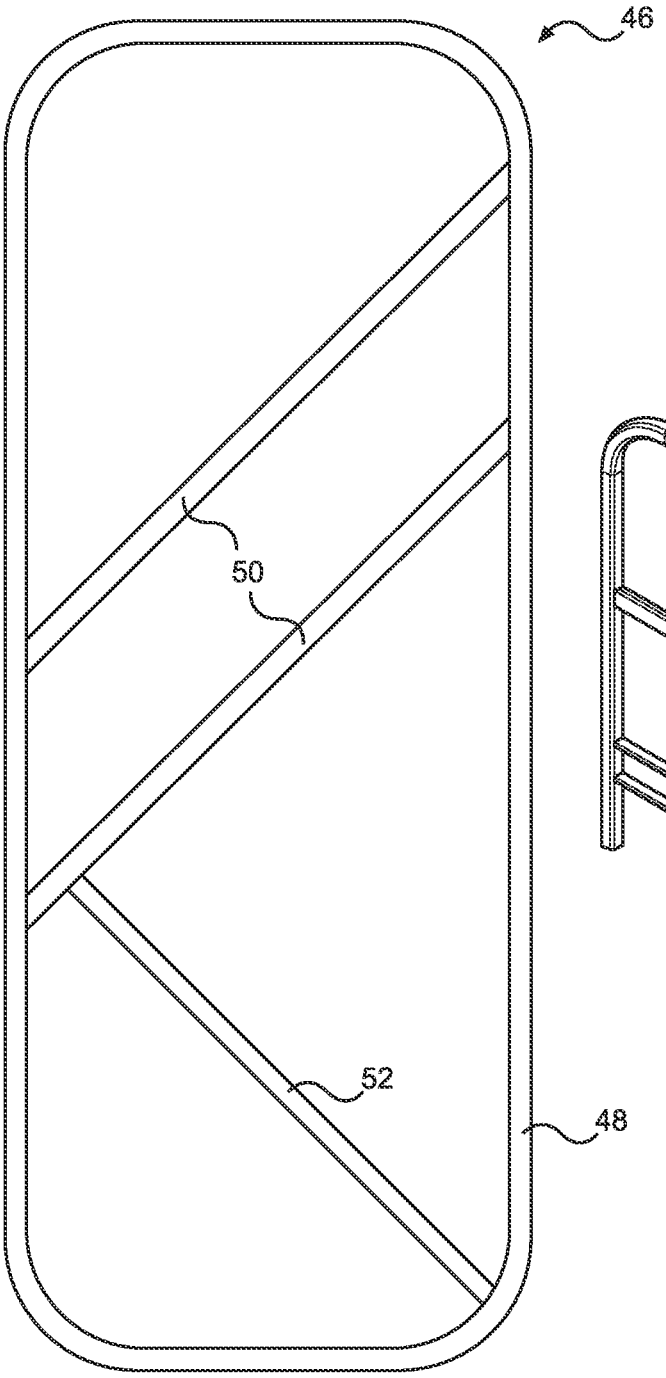
FIG. 7 is a plan view, not to scale, of details of a middle handrail assembly for the stair module of FIG. 2.
Figure 8:
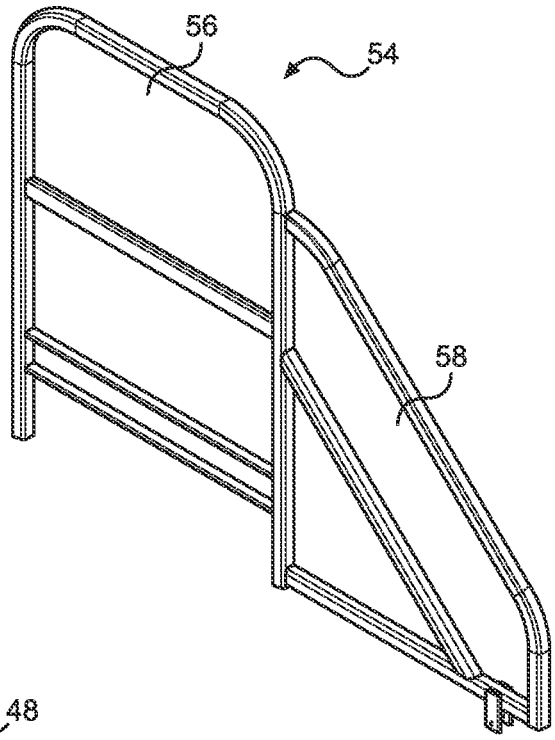
FIG. 8 is a perspective view, not to scale, of details of a top handrail assembly for the staircase of FIG. 1.

A middle handrail assembly 46 is attached to stair assemblies 34*a* and 34*b* between the stair assemblies 34*a* and 34*b*. Details of the middle handrail assembly 46 are provided in FIG. 7. The middle handrail assembly 46 has an overall rounded rectangular shape made of round or rectangular tubing 48 and includes two spaced-apart diagonal tubing members 50 also made of square or rectangular tubing material. The upper tubing member 50 may function as a handrail for the stair assemblies. A diagonal brace 52 may also be included in the middle handrail assembly 46. For the uppermost staircase module, a top handrail assembly 54 as shown in FIG. 8 may be attached to the second stair assembly 34*b* instead of the middle handrail assembly 46. The top handrail assembly 54 includes a rectangular section 56 and an angled section 58 and is also made or round or rectangular tubing material.

Figure 9:
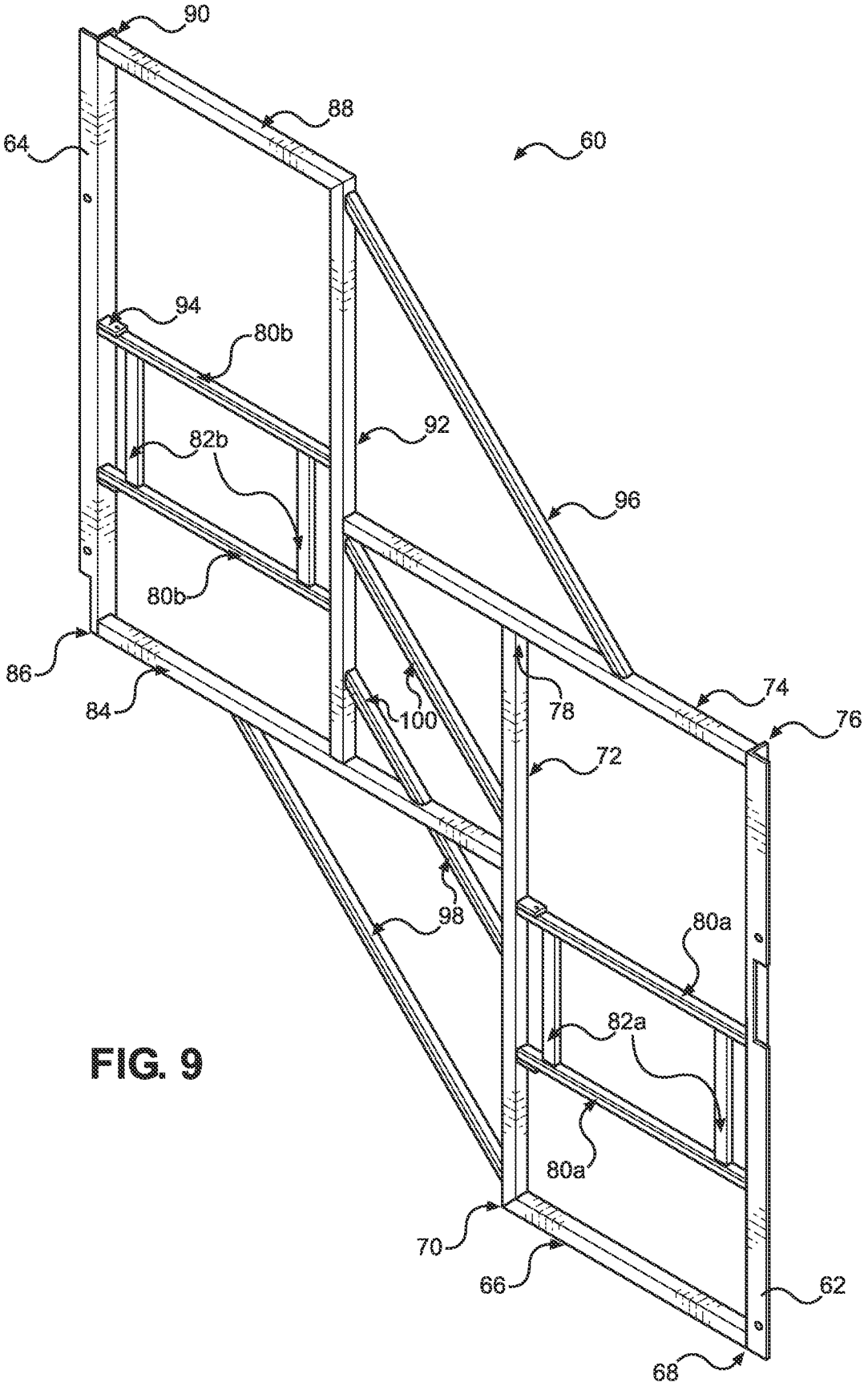
FIG. 9 is a perspective view, not to scale, of details of a second side brace for the stair module of FIG. 2.

An important feature of each staircase module 12 is a unique second side brace 60 as shown in FIG. 9 that is bolted to the elongate tubular columns 20 on the first frame member 16 and the second frame member 18 using vertical angle members 62 and 64. A short horizontal tubular frame member 66 is welded to a first end 68 of the vertical angle member 62 and to a first end 70 of a vertical tubular support member 72. A long horizontal tubular frame member 74 is welded to a second end 76 of the vertical angle member 62 and to a second end 78 of the vertical tubular support member 72. A first access gate containing horizontal members 80*a* and vertical members 82*a* welded to the horizontal members 80*a* is pivotally attached to the vertical tubular support member 72 or to vertical angle member 62. Another portion of the second side brace 60 includes a long horizontal tubular frame member 84 welded to a first end 86 of the vertical angle member 64 and to the vertical tubular support member 72. A short horizontal tubular frame member 88 welded to a second end 90 of the vertical angle member 64 and to a vertical tubular support member 92. A second access gate containing horizontal members 80*b* and vertical members 82*b* welded to the horizontal members 80*b* is pivotally attached to a bracket 94 welded to the vertical angle member 64 or vertical tubular support member 92. The access gates described above are positioned to provide access to the upper and lower landings 38 of the stair assembly 34 and thus are offset from one-another in the vertical direction. In some embodiments, the access gates are provided at four foot intervals in each of the staircase modules 12.

A diagonal tubular brace 96 is welded to the vertical tubular support member 92 and to the long horizontal tubular frame member 74. Likewise at least one and preferably two diagonal tubular braces 98 are welded to the long horizontal tubular frame member 84 and to the vertical tubular support member 72. Additional diagonal tubular braces 100 may be welded to the vertical tubular support members 72 and 92 and to the long horizontal tubular frame member 84 as shown in FIG. 9.

In another embodiment, the first or second frame members 16*a* or 18*a* may include an access gate as described above and illustrated in FIG. 10. The first or second frame member access gate includes horizontal members 80*c* and vertical members 82*c* and is pivotally attached to brackets 94 as described above. In this embodiment, the end frame 16*a* or 18*a* includes a vertical tubular support member 103 to which the bracket 94 is welded. The vertical support member 103 is welded to tubular rungs 22*a* and 22*e*. Intermediate tubular rungs 22*f*, 22*g*, and 22*h* are welded between the tubular vertical column 20 and the vertical support member 103.

Figure 11:
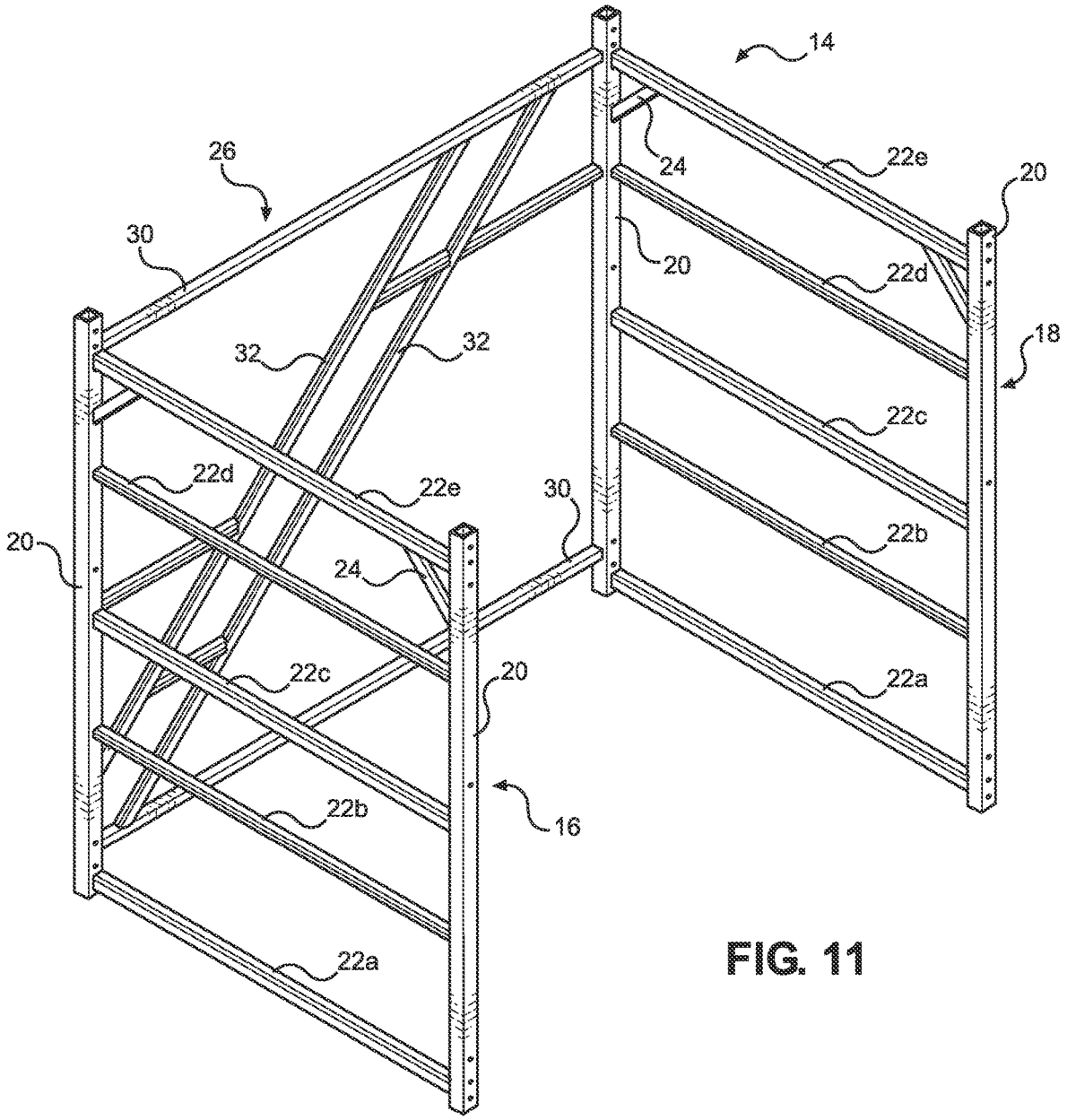
FIG. 11 is a perspective view, not to scale, of details of top level module for the staircase of FIG. 1.

A top level module 104 that does not include stair assemblies 34 may be attached to the topmost staircase module 12. The top level module includes the first frame member 16, the second frame member 18, and the first side brace 26 attached to the first frame member 16 and second frame member 18 as shown in FIGS. 1 and 11.

Referring again to FIG. 2, if the bottom staircase module 12 is adjacent to the ground, then base posts 106 may be inserted into the tubular vertical columns 20 as shown. Connector posts 108 are inserted into the tubular vertical columns 22 to attach the staircase modules 12 to one another or to attach the uppermost staircase module 12 to the top safety module section 104. Accordingly, the connector posts 108 may be bolted between the tubular vertical columns 22 that are connected to one another.

Figure 12:
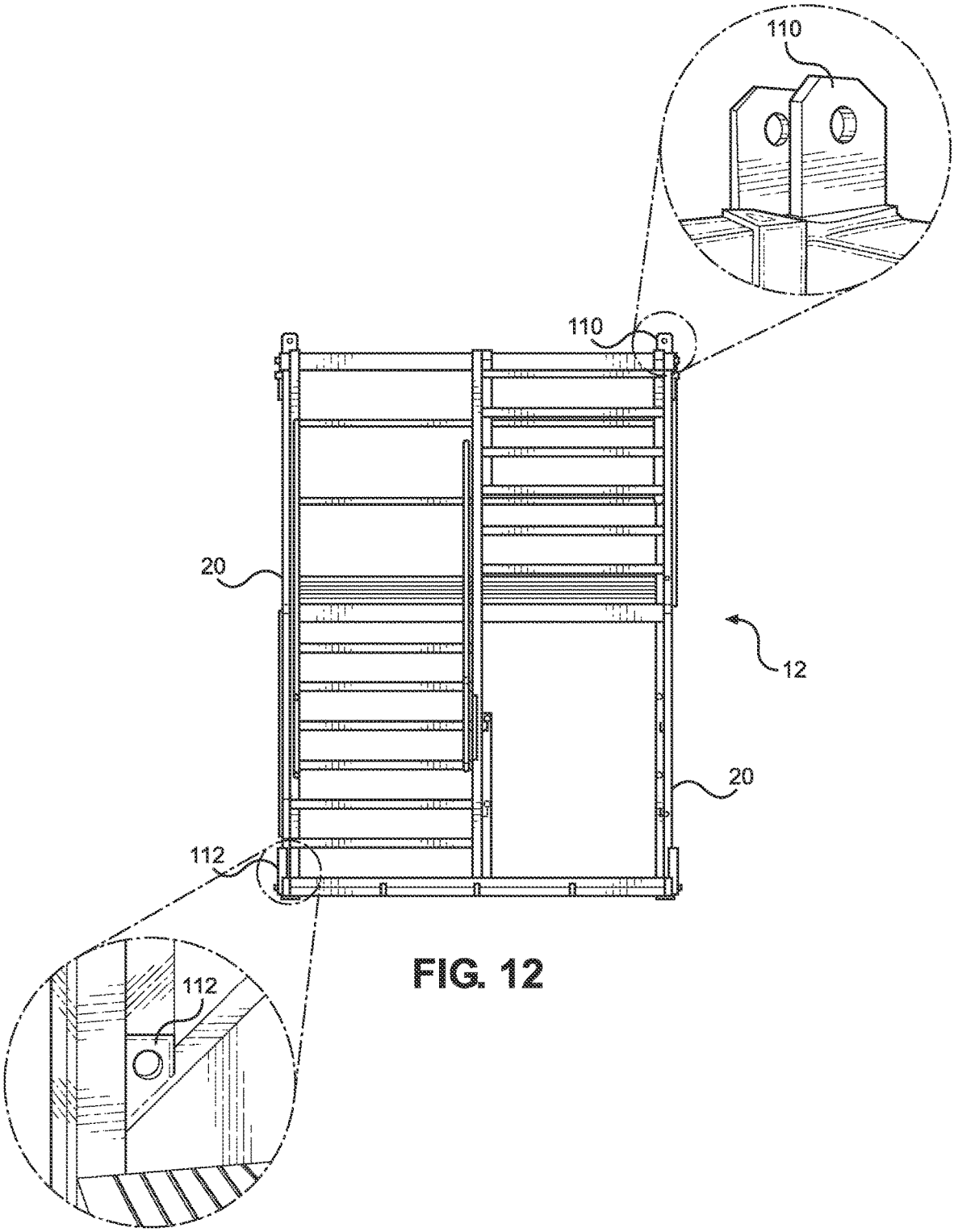
FIG. 12 is a plan and perspective views, not to scale, of details of a lifting lug for the stair module of FIG. 2.
Figure 13:
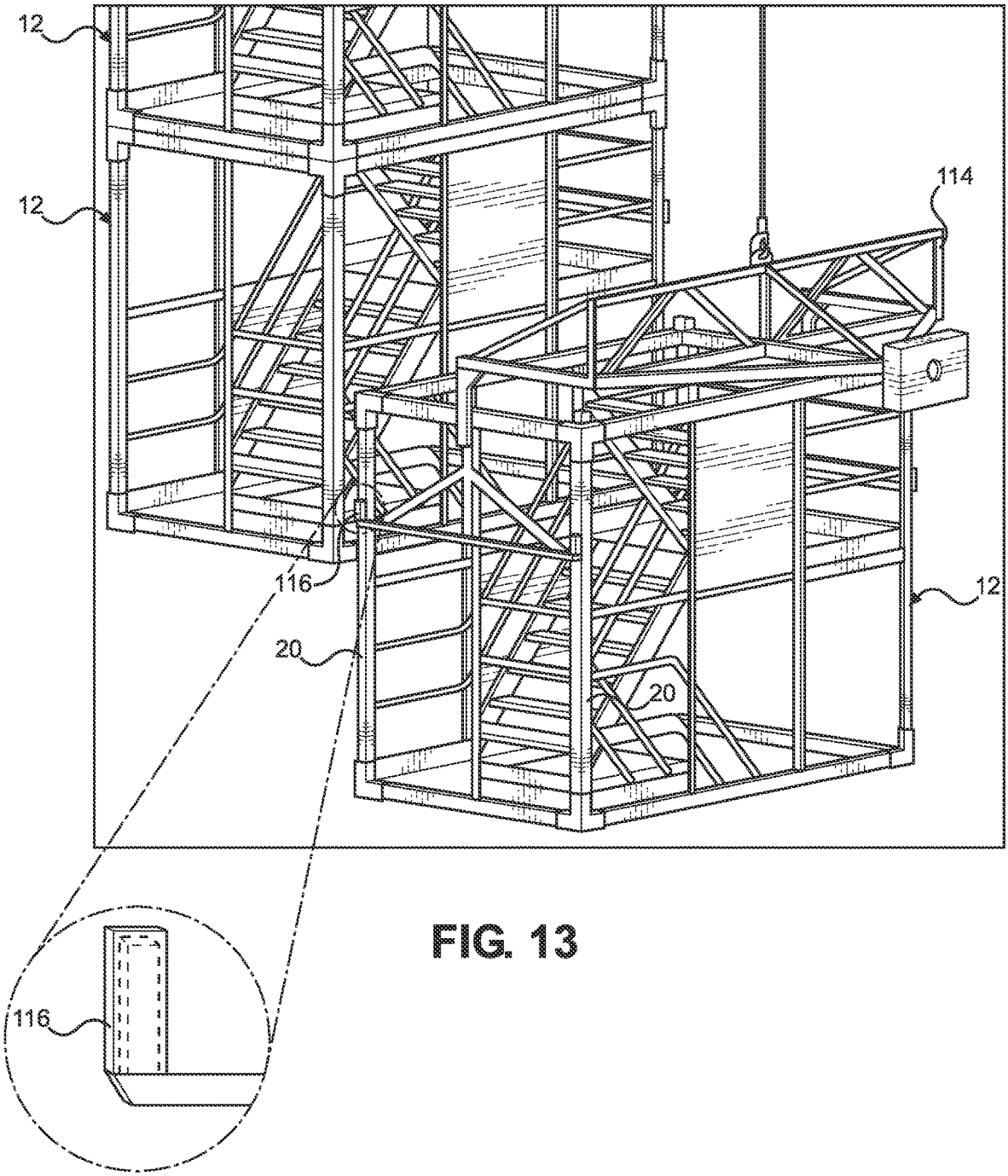
FIGS. 13 and 14 are perspective views, not to scale, of an assembly process for the stair modules of FIG. 2.
Figure 14:
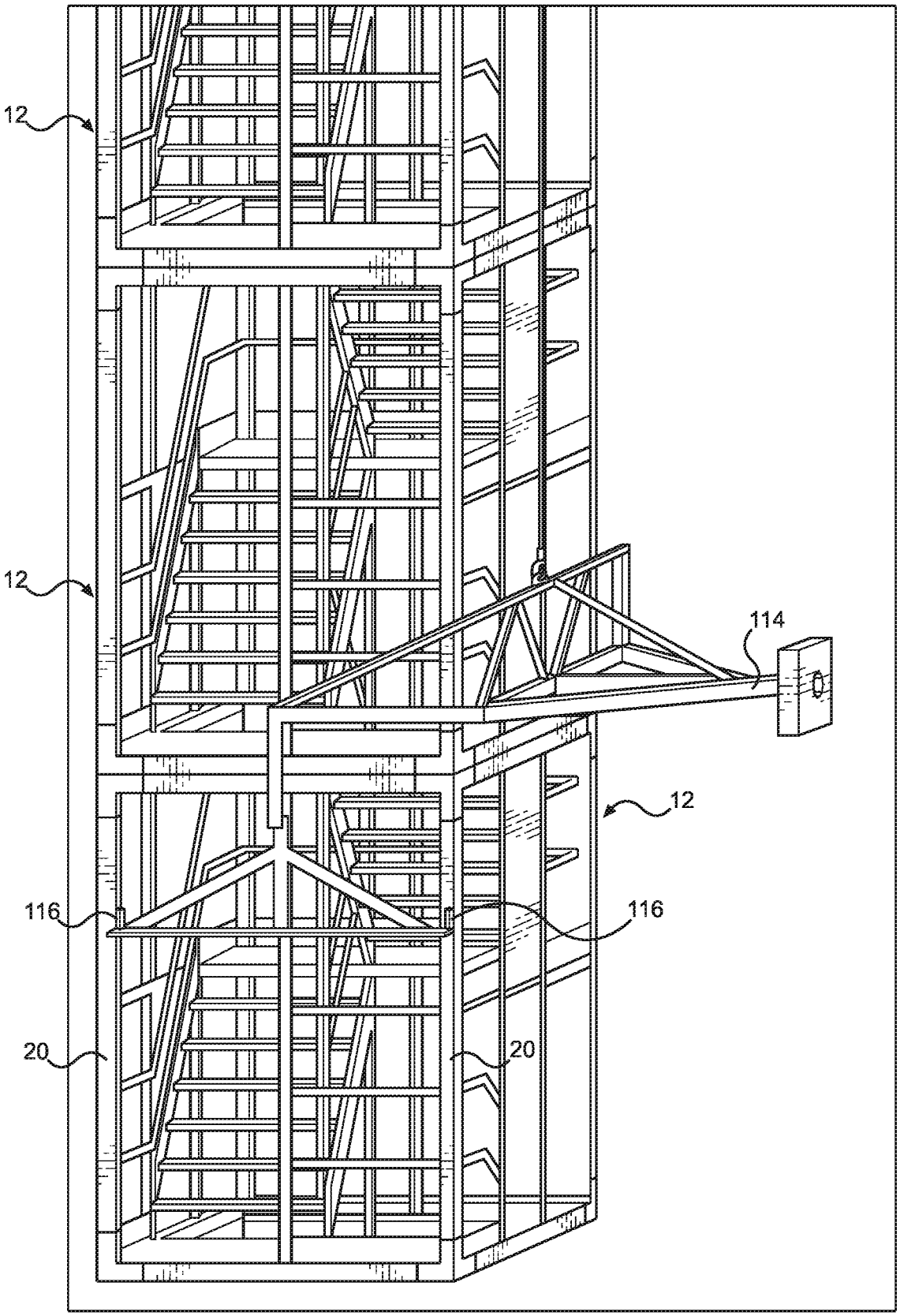
Figure 15:
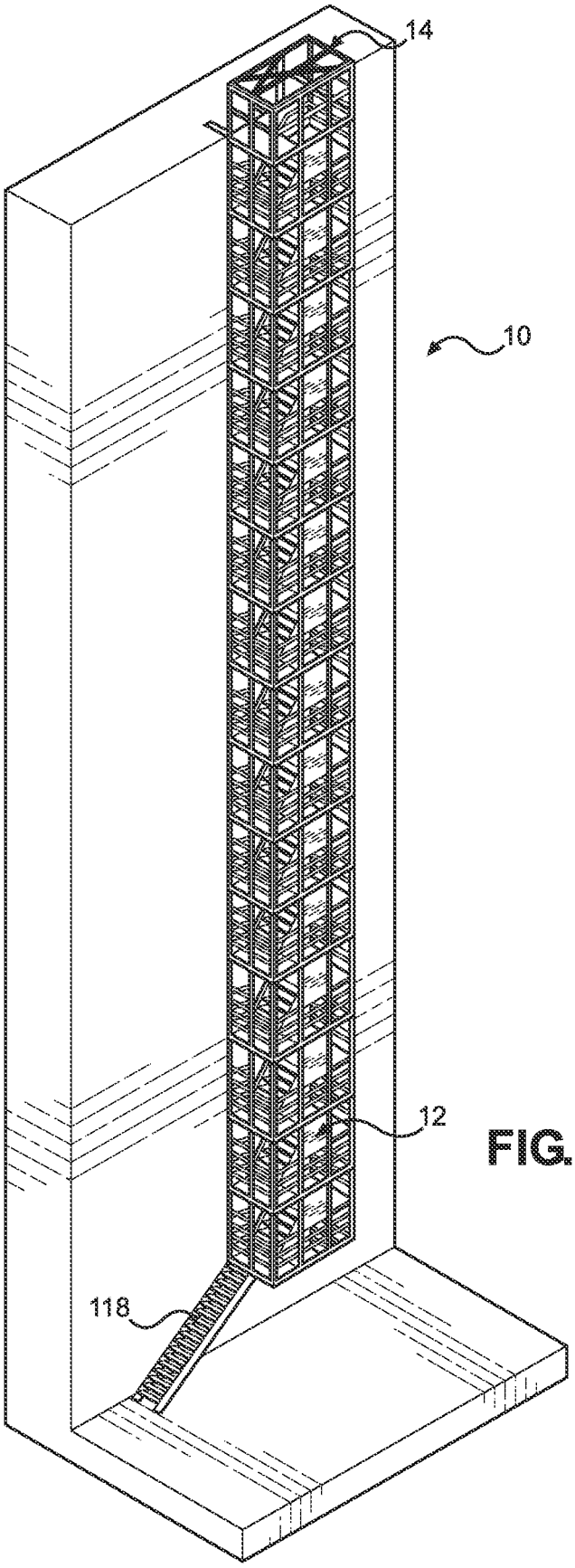
FIG. 15 is a perspective view, not to scale, of a staircase according to another embodiment of the disclosure.

In order to lift the individual assembled staircase modules 12, strategically placed lifting lugs 110 and 112 as shown in FIG. 12 are welded to the elongate tubular vertical columns 20. The lifting lugs 110 are welded or bolted to the upper portion of columns 20 and the lifting lugs 112 are welded to the lower portions of columns 20. Accordingly, two or more staircase modules 12 may be assembled together for horizontal shipping. In another embodiment, a lifting rig 114 as shown in FIGS. 13 and 14 may be used to assemble the staircase modules 12 from the top down below one another in an underground excavation or other vertical shaft. In the embodiment shown in FIG. 13, temporary or permanent sockets 116 may be attached to the tubular vertical columns 20 to enable the lifting rig 114 to lower the staircase module 12 to below a staircase module 12 already assembled in the excavtion or shaft. FIG. 15 illustrates a completed staircase that is assembled from the top down. In some embodiments, the lower staircase module 12 may include an adjustable staircase 118 attached thereto.

Figure 10:
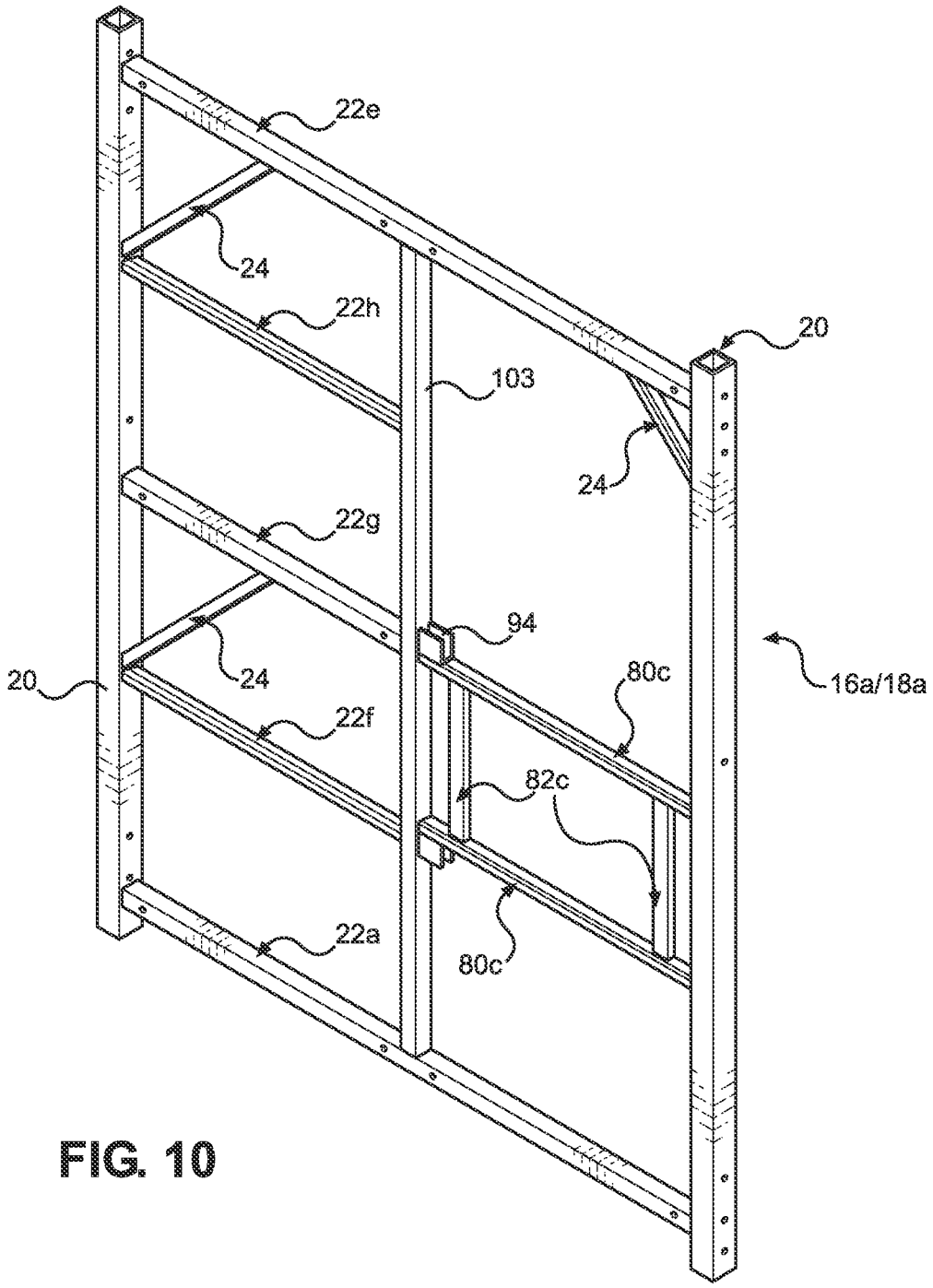
FIG. 10 is a perspective view, not to scale, of details of a frame member for the stair module of FIG. 2 according to another embodiment of the disclosure.
Figure 16:
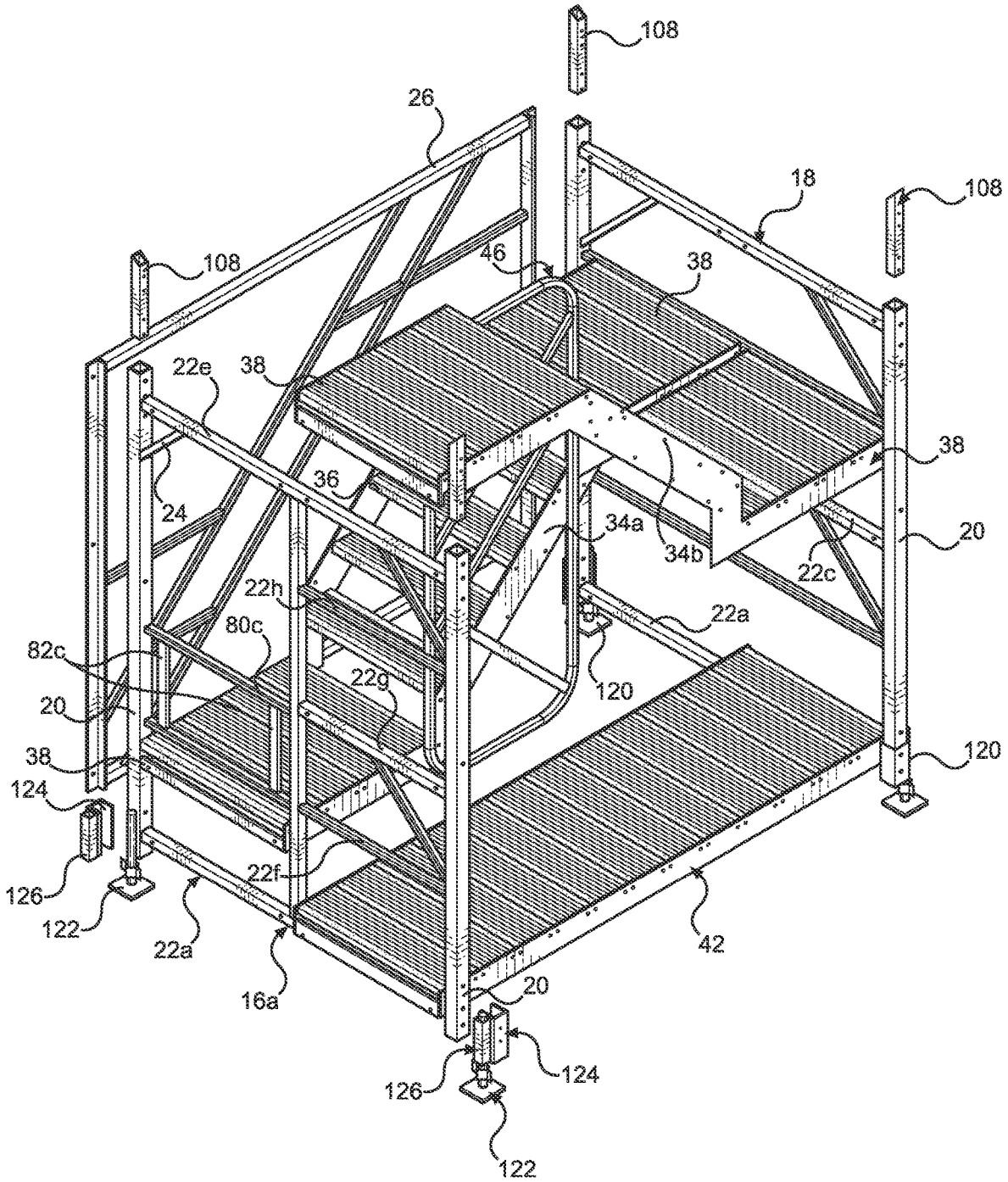
FIG. 16 is an exploded, perspective view, not to scale, of a stair module for the staircase of FIG. 1 according to another embodiment of the disclosure.

In another embodiment of the disclosure, the staircase module 12*a* (FIG. 16) may contain a first frame member 16*a* as shown in FIG. 10 that includes the access gate described above. However, unlike the embodiment shown in FIG. 2, adjustable base posts 120 that include an adjustable stand 122 and a column attachment may be used instead of the base posts 106 shown in FIG. 2. The column attachment includes a channel 124 that can be bolted onto the elongate tubular columns 20 rather than inserted into the columns 20, and a welded to a lifting tube 126 into which the adjustable adjustable stand 122 can be inserted.

The staircase 10 according to the disclosure is almost entirely made of light weight, high tensile strength, marine grade aluminum and is fabricated to meet all required dimensions of a temporary stairway access according to AS NZS 1576. The staircase 10 according to the disclosure may be used to access basement excavations by using prefabricated stair modules 12 that can be assembled on site to provide the staircase 12. The staircase 10 may also be used for fast, easy and safe access for emergency personnel to access a station busy in an emergency situation since the staircase can be quickly deployed and provides a sturdy platform for personnel and stretchers. In the case of vertical shaft access, such as ventilation shafts, the staircase 10 can be use to create temporary work stations. As descried above, the staircase 10 may be assembled from individual stair modules 12 on site or shipped with multiple stair modules 12 already assembled to one another and lifted by a crane to the work location. The staircase 10 may provide permanent access for maintenance personnel or temporary access during a construction project.

The foregoing description of preferred embodiments have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A staircase module comprising:

a first frame member having first and second elongate vertical columns and multiple spaced-apart rungs connecting the first and second elongate vertical columns, a second frame member having third and fourth elongate vertical columns and multiple spaced apart rungs connecting the third and fourth elongate vertical columns, a first stair assembly attached to one of the multiple spaced-apart rungs on the first frame member and to one of the multiple spaced-apart rungs on the second frame member, a second stair assembly attached to one of the multiple spaced-apart rungs on the second frame member and one of the multiple spaced-apart rungs on the first frame member, and a first side brace secured between the first and second frame members such that the first side brace is disposed adjacent the first stair assembly, the first side brace including a first vertical member secured to the first elongate vertical column of the first frame member, a second vertical member secured to the third elongate column of the second frame member, and one or more diagonal members positioned between the first vertical member and the second vertical member such that the one or more diagonal members are positioned and configured to provide a handrail for the first stair assembly.

2. The staircase module of claim 1, wherein each of the first and second stair assemblies comprises notches configured for engaging one of the multiple spaced-apart rungs to secure the first and second stair assemblies to the first and second frame members.

3. The staircase module of claim 1, further comprising a handrail assembly attached between the first and second stair assemblies such that the handrail assembly provides a middle handrail to each of the first and second stair assemblies.

4. The staircase module of claim 1, wherein each of the first and second stair assemblies comprises a plurality of stair treads between two landings.

5. The staircase module of claim 1, further comprise a plurality of lifting lugs positioned adjacent at least one of a lower end and an upper end of the first, second, third, and fourth elongate vertical columns.

6. A staircase comprising a plurality of staircase modules of claim 1 stacked together to provide the staircase.

7. The staircase module of claim 1, further comprising a second side brace secured between the first and second frame members opposite the first side brace such that the second side brace is disposed adjacent the second stair assembly, the second side brace including a first vertical member secured to the second elongate vertical column of the first frame member, a second vertical member secured to the fourth elongate vertical column of the second frame member, and at least one access gate disposed between the first vertical member and the second vertical member of the second side brace.

8. The staircase module of claim 7, wherein the at least one access gate includes a first access gate and a second access gate each disposed between the first vertical member and the second vertical member of the second side brace, and wherein the first access gate is offset from the second access gate in both a vertical and horizontal direction within the second side brace.

9. A method for assembling a staircase, comprising:

pre-assembling at least a first and a second staircase module, each of the first and second staircase module comprising:

a first frame member having first and second elongate vertical columns and multiple spaced-apart rungs connecting the first and second elongate vertical columns, a second frame member having third and fourth elongate vertical columns and multiple spaced apart rungs connecting the third and fourth elongate vertical columns, a first stair assembly attached to one of the multiple spaced-apart rungs on the first frame member and to one of the multiple spaced-apart rungs on the second frame member, a second stair assembly attached to one of the multiple spaced-apart rungs on the second frame member and to one of the multiple spaced-apart rungs on the first frame member, a first side brace secured between the first and second frame members such that the first side brace is disposed adjacent the first stair assembly, the first side brace including a first vertical member secured to the first elongate vertical column of the first frame member, a second vertical member secured to the third elongate column of the second frame member, and one or more diagonal members positioned between the first vertical member and the second vertical member such that the one or more diagonal members are positioned and configured to provide a handrail for the first stair assembly, and a second side brace secured between the first and second frame members, wherein the second side brace further comprises an access gate, attaching a connector post to at least a first end of each of the first, second, third, and fourth elongate vertical columns of the first staircase module;

aligning a second end of each of the first, second, third, and fourth elongate vertical columns of the second staircase module to the first end of the first, second, third and fourth elongate vertical columns of the first staircase module, and attaching the second staircase module and first staircase module to one another by attaching the second end of the first, second, third, and fourth elongate vertical columns of the second staircase module to the corresponding connector posts attached to the first end of the first, second, third, and fourth elongate vertical columns of the first stair case module.

10. The method of claim 9, wherein the second staircase module is attached above the first staircase module.

11. The method of claim 9, wherein the second staircase module is attached below the first staircase module.

12. The method of claim 9, wherein the step of pre-assembling comprises pre-assembling three or more staircase modules.

13. The method of claim 12, wherein the staircase comprises from 3 to 15 staircase modules.

14. The method of claim 9, wherein the second side brace includes a first vertical member secured to the second elongate vertical column of the first frame member and a second vertical member secured to the fourth elongate vertical column of the second frame member, and wherein the access gate is disposed between the first vertical member and the second vertical member of the second side brace.

15. The method of claim 14, wherein the second side brace of each staircase module comprises two access gates disposed between the first vertical member and the second vertical member of the second side brace, and wherein a first access gate of the two access gates is offset from a second access gate of the two access gates in both a vertical and horizontal direction within the second side brace.

16. A staircase module comprising:

a first frame member having first and second elongate vertical columns and a plurality of spaced-apart rungs connecting the first and second elongate vertical columns;

a second frame member having third and fourth elongate vertical columns and at least one spaced apart rung connecting the third and fourth elongate vertical columns;

a first stair assembly attached to one of the plurality of spaced-apart rungs the first frame member and to the at least one spaced apart rung of the second frame member such that the first stair assembly is disposed within the first frame member and the second frame member;

a second stair assembly attached to the at least one spaced-apart rung of the second frame member and to one of the plurality of multiple spaced-apart rungs of the first frame member such that the second stair assembly is disposed within the first frame member and the second frame member adjacent to the first stair assembly;

a first side brace secured between the first and second frame members such that the first side brace is disposed adjacent the first stair assembly, the first side brace including a first vertical member secured to the first elongate vertical column of the first frame member and a second vertical member secured to the third elongate column of the second frame member; and a second side brace secured between the first and second frame members opposite the first side brace such that the second side brace is disposed adjacent the second stair assembly, the second side brace including a first vertical member secured to the second elongate vertical column of the first frame member, a second vertical member secured to the fourth elongate vertical column of the second frame member, and a first access gate and a second access gate each disposed between the first vertical member and the second vertical member of the second side brace, wherein the first access gate is offset from the second access gate in both a vertical and horizontal direction within the second side brace.

17. The staircase module of claim 16, further comprising a handrail assembly disposed between the first and second stair assemblies such that the handrail assembly provides a middle handrail to each of the first and second stair assemblies.

* * * * *